US010499701B2

(12) United States Patent
Cai et al.

(10) Patent No.: US 10,499,701 B2
(45) Date of Patent: Dec. 10, 2019

(54) ONE-PIECE-VAMP MANUFACTURE METHOD AND ONE-PIECE-WOVEN-VAMP

(71) Applicant: Sincetech (Fujian) Technology Co., Ltd., Quanzhou, Fujian (CN)

(72) Inventors: Qinglai Cai, Fujian (CN); Jingwei Cai, Fujian (CN); Jianfei Xu, Fujian (CN); Lizhi Cai, Fujian (CN)

(73) Assignee: SINCETECH (FUJIAN) TECHNOLOGY CO., LTD., Jinjiang, Quanzhou (CN)

( * ) Notice: Subject to any disclaimer, the term of this patent is extended or adjusted under 35 U.S.C. 154(b) by 271 days.

(21) Appl. No.: 15/619,857

(22) Filed: Jun. 12, 2017

(65) Prior Publication Data

US 2018/0020761 A1 Jan. 25, 2018

(30) Foreign Application Priority Data

Jul. 25, 2016 (CN) ..... 2016 1 0585301

(51) Int. Cl.

| | |
|---|---|
| ***A43B 1/04*** | (2006.01) |
| ***A43B 23/02*** | (2006.01) |
| ***A43B 23/04*** | (2006.01) |
| ***D03D 3/02*** | (2006.01) |
| ***D03D 15/00*** | (2006.01) |
| ***D03D 15/08*** | (2006.01) |
| ***D03D 1/00*** | (2006.01) |

(52) U.S. Cl.

CPC ..... *A43B 1/04* (2013.01); *A43B 23/0215* (2013.01); *A43B 23/0245* (2013.01); *A43B 23/042* (2013.01); *D03D 3/02* (2013.01); *D03D 15/0033* (2013.01); *D03D 15/08* (2013.01); *A43B 23/04* (2013.01); *D03D 1/00* (2013.01); *D03D 2700/03* (2013.01); *D10B 2501/043* (2013.01)

(58) Field of Classification Search

CPC ..... A43B 1/04; A43B 23/042; A43B 23/0215; A43B 23/0245; A43B 23/04; D03D 15/08; D03D 15/0033; D03D 1/00; D03D 3/02; D03D 2700/03; D10B 2501/043

USPC ..... 36/45, 46.5, 47, 48, 49; 139/387 R, 139/420 R, 421

See application file for complete search history.

(56) References Cited

U.S. PATENT DOCUMENTS 19,625 A * 3/1858 Cooley et al. ..... D03D 3/00 139/388

27,819 A * 4/1860 McBurney ..... B29D 23/001 138/126

(Continued)

*Primary Examiner* — Jameson D Collier

*Assistant Examiner* — Jocelyn Bravo

(74) *Attorney, Agent, or Firm* — Harness, Dickey & Pierce, P.L.C.; Anthony G. Fussner

(57) ABSTRACT

A one-piece-vamp manufacture method includes: (1) weaving preparation: arranging different required raw material color yarn, hot melt silk and stretch yarn at a main color opening yarn feeding orifice, a match color opening yarn feeding orifice and a stretch yarn yarn feeding orifice; (2) weaving U shape tube fabric: a vamp machine weaving in an order of a starting opening, an outer toe cap, an outer shoe body, an outer heel, an outer shoe opening to an inner shoe opening, an inner heel, an inner shoe body, an inner toe cap; (3) stitching an inner toe cap stitch eyelet; (4) stitching the outer toe cap stitch eyelet; (5) forming a one-piece-vamp semifinished product; and (6) reshaping, setting and shape fixing.

7 Claims, 1 Drawing Sheet

(56) References Cited

U.S. PATENT DOCUMENTS 30,534 A * 10/1860 Heppenstall ..... D03D 3/00 139/387 R
217,467 A * 7/1879 Lee ..... A43B 23/02 36/47
597,672 A * 1/1898 Fittz ..... D03D 3/00 139/387 R
803,798 A * 11/1905 Van Vriesland ..... F21H 1/00 431/100
955,541 A * 4/1910 Petersen ..... D03D 3/00 139/387 R
991,034 A * 5/1911 Smith ..... D03D 11/00 139/384 R
1,129,037 A * 2/1915 Jennings ..... D03D 3/00 139/387 R
1,423,524 A * 7/1922 Hill ..... D03D 3/00 139/389
1,741,491 A * 12/1929 Ansell ..... B29D 23/001 138/126
1,879,144 A * 9/1932 Emery ..... A43C 11/002 36/3 A
1,947,924 A * 2/1934 Sery ..... D03D 3/00 87/29
1,956,969 A * 5/1934 Ayers ..... A43B 23/25 12/146 C
2,007,918 A * 7/1935 Morse ..... B29D 23/001 138/126
2,202,996 A * 6/1940 Sackner ..... D03D 3/00 139/389
2,208,256 A * 7/1940 Goldsmith ..... D03D 3/00 139/389
2,239,293 A * 4/1941 Mosier ..... D03D 3/00 139/420 R
2,250,261 A * 7/1941 Goldsmith ..... D03D 3/00 139/387 R
2,259,274 A * 10/1941 Stohlman ..... B65D 29/00 139/389
2,440,393 A * 4/1948 Clark ..... A43B 1/02 12/142 G
2,471,380 A * 5/1949 Wallwork ..... D03D 3/00 28/158
2,475,012 A * 7/1949 Cole ..... D03D 3/00 139/388
2,701,458 A * 2/1955 Ducharme ..... D04B 1/26 66/180
2,924,250 A * 2/1960 Sidebotham ..... A61F 2/06 139/387 R
3,581,412 A * 6/1971 Dalebout ..... A43B 19/00 36/117.6
3,602,931 A * 9/1971 MacArthur ..... A43B 23/16 12/146 D
3,638,262 A * 2/1972 Mitchell ..... A43B 3/106 12/142 MC
3,641,603 A * 2/1972 Lockwood ..... A43D 8/006 12/146 C
3,669,157 A * 6/1972 Woodall, Jr. ..... B29C 61/0658 139/387 R
3,698,027 A * 10/1972 Schwab ..... B29D 35/06 12/142 R
3,720,971 A * 3/1973 Wyness ..... A43D 8/006 12/146 C
3,786,580 A * 1/1974 Dalebout ..... A43B 5/0405 36/93
3,970,116 A * 7/1976 Takada ..... A62B 1/20 139/387 R
4,015,641 A * 4/1977 Goff, Jr. ..... D03D 11/02 139/384 R
4,025,684 A * 5/1977 Neidhardt ..... A47C 27/081 442/206
4,034,431 A * 7/1977 Fukuoka ..... A43B 1/0027 12/142 MC
4,055,201 A * 10/1977 Fowler ..... B65D 83/0061 139/421
4,145,822 A * 3/1979 Mitchell ..... A43B 3/24 36/87
4,174,739 A * 11/1979 Rasero ..... D03D 3/02 139/383 A
4,194,308 A * 3/1980 Karlsson ..... A43B 3/02 12/142 G
4,266,750 A * 5/1981 Gallizia ..... A43B 3/0084 12/135 R
4,272,859 A * 6/1981 Vanhove ..... A43B 3/163 12/142 K
4,500,578 A * 2/1985 van de Kamp ..... B66C 1/18 428/36.1
4,649,842 A * 3/1987 Backmann ..... D05B 11/00 112/117
4,651,659 A * 3/1987 Bernardon ..... D05B 33/00 112/308
4,660,605 A * 4/1987 Koch ..... B60R 22/12 139/117
4,662,018 A * 5/1987 Autry ..... A43B 9/00 12/142 RS
4,668,545 A * 5/1987 Lowe ..... B29C 61/0658 139/387 R
4,703,532 A * 11/1987 Ciucani ..... A43D 95/02 12/142 MC
4,957,054 A * 9/1990 Sakuma ..... A41D 27/10 112/470.13
5,253,434 A * 10/1993 Curley, Jr. ..... A43B 23/07 12/142 F
5,313,897 A * 5/1994 Katamine ..... B25J 15/0019 112/470.13
5,319,807 A * 6/1994 Brier ..... A41B 11/02 2/239
5,345,638 A * 9/1994 Nishida ..... A41H 3/08 12/146 C
5,365,677 A * 11/1994 Dalhgren ..... A43B 1/04 36/3 A
5,381,610 A * 1/1995 Hanson ..... A43B 3/24 12/142 T
5,381,743 A * 1/1995 Moll ..... D05B 23/00 112/2.1
5,509,282 A * 4/1996 Ferrell, Jr. ..... A41B 11/005 66/188
5,544,602 A * 8/1996 Kawasaki ..... D05B 21/00 112/148
5,564,476 A * 10/1996 Golz ..... D03D 3/02 139/387 R
5,778,702 A * 7/1998 Wrightenberry ..... A41B 11/005 2/239
5,800,514 A * 9/1998 Nunez ..... A61F 2/06 139/384 R
5,829,373 A * 11/1998 Baxter ..... B29C 70/543 112/176
5,913,894 A * 6/1999 Schmitt ..... A61L 27/16 623/1.51
5,988,085 A * 11/1999 Martz ..... D05B 39/00 112/470.13
6,045,884 A * 4/2000 Hess ..... D03D 3/02 428/36.1
6,158,253 A * 12/2000 Svoboda ..... A41B 11/004 2/239
6,673,728 B1 * 1/2004 Newbill ..... B60R 21/233 139/384 R
6,777,051 B1 * 8/2004 Mazzer ..... D03D 15/00 138/118.1
7,051,460 B2 * 5/2006 Orei ..... A43B 1/00 36/84
7,484,539 B1 * 2/2009 Huang ..... D03D 3/02 139/384 R
7,600,539 B2 * 10/2009 Malloy ..... D03D 15/02 139/387 R
7,841,369 B1 * 11/2010 Osborne ..... A41D 13/0012 139/319
9,675,134 B2 * 6/2017 Kosui ..... D04B 1/22
9,986,780 B2 * 6/2018 Lien ..... A43B 1/04
10,240,271 B2 * 3/2019 Freer ..... B25J 11/00
10,316,441 B2 * 6/2019 Ly ..... A43B 1/04

(56) References Cited

U.S. PATENT DOCUMENTS 10,368,614 B2 * 8/2019 Kilgore ..... A43B 23/0245
2001/0039816 A1 * 11/2001 Fujiwara ..... D04B 15/06 66/13
2001/0052248 A1 * 12/2001 Ando' ..... D04B 9/56 66/148
2003/0215228 A1 * 11/2003 Uchiyama ..... G03B 17/02 396/6
2003/0224684 A1 * 12/2003 Botturi ..... A61N 1/16 442/187
2003/0233743 A1 * 12/2003 Wu ..... A61N 1/14 28/140
2004/0115677 A1 * 6/2004 Mitsuhashi ..... B01L 3/50851 435/6.14
2004/0142486 A1 * 7/2004 Weselak ..... G01N 35/028 436/174
2004/0154341 A1 * 8/2004 Conti ..... D04B 9/40 66/149 S
2004/0168478 A1 * 9/2004 Conti ..... D05B 7/00 66/147
2004/0211226 A1 * 10/2004 Frullini ..... D04B 9/40 66/147
2004/0244427 A1 * 12/2004 Lee ..... C03C 25/26 65/438
2004/0244431 A1 * 12/2004 Magni ..... D04B 9/40 66/147
2005/0028246 A1 * 2/2005 Lee ..... A42C 5/02 2/183
2005/0081402 A1 * 4/2005 Orei ..... A43B 1/00 36/45
2005/0115279 A1 * 6/2005 Magni ..... D04B 9/40 66/148
2005/0217748 A1 * 10/2005 Ikegami ..... A62B 35/04 139/388
2006/0096073 A1 * 5/2006 Stoppa ..... D02G 3/328 28/166
2006/0144095 A1 * 7/2006 Frullini ..... D04B 9/02 66/8
2006/0157137 A1 * 7/2006 Sayler ..... D03D 29/00 139/29
2006/0169345 A1 * 8/2006 Speich ..... D03C 3/10 139/55.1
2006/0179810 A1 * 8/2006 Liao ..... D01F 8/14 57/200
2006/0231153 A1 * 10/2006 Jackson ..... D03D 13/00 139/370.1
2007/0116795 A1 * 5/2007 Sayers ..... B29C 31/008 425/395
2007/0163667 A1 * 7/2007 Crook ..... D21F 1/0054 139/387 R
2007/0224897 A1 * 9/2007 Shimazaki ..... B32B 5/12 442/65
2007/0271821 A1 * 11/2007 Meschter ..... A43B 3/26 36/45
2008/0228028 A1 * 9/2008 Carlson ..... A61F 2/07 600/36
2009/0068428 A1 * 3/2009 Shinoda ..... B29B 11/16 428/212
2009/0163099 A1 * 6/2009 Ackroyd ..... D03D 15/00 442/181
2010/0037483 A1 * 2/2010 Meschter ..... A43B 3/26 36/47
2010/0077634 A1 * 4/2010 Bell ..... A41D 27/24 36/54
2010/0115792 A1 * 5/2010 Muller ..... A43B 7/125 36/83
2010/0159768 A1 * 6/2010 Lee ..... B29C 44/357 442/189
2011/0192060 A1 * 8/2011 Crain ..... A43B 9/00 36/30 R
2011/0318513 A1 * 12/2011 Marsal ..... B29B 11/16 428/35.7
2012/0255201 A1 * 10/2012 Little ..... A43B 1/04 36/84
2012/0277850 A1 * 11/2012 Bertini ..... A61F 2/06 623/1.15
2013/0048139 A1 * 2/2013 Burdy ..... D03D 1/0041 139/291 R
2013/0081307 A1 * 4/2013 del Biondi ..... A43B 3/0036 36/83
2013/0312284 A1 * 11/2013 Berend ..... A43B 1/0027 36/84
2014/0245632 A1 * 9/2014 Podhajny ..... A43B 1/04 36/45
2014/0352173 A1 * 12/2014 Bell ..... A43B 1/04 12/142 G
2014/0360048 A1 * 12/2014 DeHaven ..... A43B 13/141 36/83
2014/0373389 A1 * 12/2014 Bruce ..... A43B 23/0215 36/87
2015/0027001 A1 * 1/2015 VanDernoot ..... A43B 7/125 36/87
2015/0053148 A1 * 2/2015 Huang ..... A01K 13/007 119/850
2015/0101133 A1 * 4/2015 Manz ..... A43D 95/14 12/142 R
2015/0129078 A1 * 5/2015 Yun ..... A43B 1/04 139/421
2015/0189951 A1 * 7/2015 Regan ..... A43D 5/00 12/103
2015/0201707 A1 * 7/2015 Bruce ..... A43B 23/0235 36/47
2015/0218737 A1 * 8/2015 Blakely ..... D03D 15/06 428/131
2015/0237960 A1 * 8/2015 Mallen ..... D04H 13/00 36/55
2016/0044985 A1 * 2/2016 Lien ..... A43B 1/04 12/142 G
2016/0165990 A1 * 6/2016 Peterson ..... D03D 1/0041 2/171
2016/0368249 A1 * 12/2016 Schwab ..... B32B 7/05
2017/0044695 A1 * 2/2017 Hays ..... D02J 1/00
2017/0129200 A1 * 5/2017 Adami ..... B29C 35/0805
2017/0172240 A1 * 6/2017 Massey ..... A41D 31/02
2017/0325513 A1 * 11/2017 Jeong ..... A41B 11/003
2018/0036091 A1 * 2/2018 Scholan ..... A61B 34/30
2018/0057977 A1 * 3/2018 Zhang ..... D03D 1/0041
2018/0135213 A1 * 5/2018 Bell ..... D03D 1/00
2018/0206585 A1 * 7/2018 Cai ..... A43B 1/04
2018/0237955 A1 * 8/2018 Lee ..... D01F 6/84
2018/0303179 A1 * 10/2018 Konukoglu ..... A41D 1/06
2018/0303203 A1 * 10/2018 Constantinou ..... A43B 1/14
2018/0305847 A1 * 10/2018 Wen ..... D04B 21/202
2019/0029369 A1 * 1/2019 VanWagnen ..... A43B 23/0245
2019/0060973 A1 * 2/2019 Yasutomi ..... B21D 28/16
2019/0075888 A1 * 3/2019 Yip ..... A43B 1/04
2019/0231022 A1 * 8/2019 Zavala ..... D04B 1/104

* cited by examiner

ONE-PIECE-VAMP MANUFACTURE METHOD AND ONE-PIECE-WOVEN-VAMP

CROSS-REFERENCE TO RELATED APPLICATION

This application claims the benefit and priority of Chinese Invention Patent Application No. 201610585301.4 filed Jul. 25, 2016. The entire disclosure of the above application is incorporated herein by reference.

TECHNICAL FIELD

The present invention relates to a technical field of shoemaking, specifically, to a one-piece-vamp manufacture method and a one-piece-woven-vamp.

BACKGROUND

This section provides background information related to the present disclosure which is not necessarily prior art.

Entirely knitted vamps have become a new series of products of vamps. Such products have advantages of being light and thin and ventile, having various design and colors, etc, and they have become popular in the market. However, with regard to the present knitted vamp, planar fabric is generally woven. Several shoe model vamps are arranged on the planar fabric. Jacquard, hollowed-out, etc, are designed on corresponding portions of the shoe model vamps. Then, the vamp is cut with a laser. However, the laser cutting is time consuming, and the cost of the equipment is high. Some vamps need laser cutting for a second time after embroidery or adhesion to other fabric is done, this manufacture process is complicated and will waste lots of leftover bits and pieces. Connection between the planar vamp and the shoe sole needs accurate lathe work, otherwise it will affect the size and model of shoes, and therefore the sizes of shoes are not standard and unified, which affects the comfort and appearance. All these make the manufacturing cost of shoes high. In addition, with regard to ordinary knitted vamps, fabric is soft, straightness of the vamp is inadequate, the vamp is prone to collapse. The appearance and quality of the vamp are affected.

SUMMARY

This section provides a general summary of the disclosure, and is not a comprehensive disclosure of its full scope or all of its features.

With respect to the above mentioned problems existing in the prior art, the technical problem to be solved by the present invention is to provide a one-piece-vamp manufacture method and a one-piece-vamp. With regard to said method and said vamp, the manufacture process is simple, the production efficiency is high, the size and model of the vamp are standard and unified, the vamp is straight, the quality of modeling is good, no leftover bits and pieces are generated, and the production cost is reduced.

The technical solutions of the present invention are as follows: A one-piece-vamp manufacture method includes the following steps:

(1) weaving preparation: arranging different required raw material color yarn, hot melt silk and stretch yarn at a main color opening yarn feeding orifice, a match color opening yarn feeding orifice and a stretch yarn yarn feeding orifice according to vamp patterns and process requirements, loading written program into a vamp machine, inputting corresponding parameters;

(2) weaving U shape tube fabric: one side of the U shape tube fabric being an outer vamp, the other side being an inner vamp, both the outer vamp and the inner vamp being of a tube shape, a turn in the middle of the U shape tube fabric being a shoe opening part where the inner vamp and the outer vamp intersect; the vamp machine weaving in an order of a starting opening, an outer toe cap, an outer shoe body, an outer heel, an outer shoe opening to an inner shoe opening, an inner heel, an inner shoe body, an inner toe cap, during the course of weaving, achieving technical effects of local jacquard, local texturing at the outer vamp with respect to processes and functions required by respective portions of the vamp;

(3) stitching an inner toe seam: grasping the woven U shape tube fabric to a stitching device by an automatic robot arm, locating the inner toe opening at a needle position of the apparatus, performing aligned automatic stitching along the inner toe opening to form the inner toe seam;

(4) stitching the outer toe seam: sucking the U shape tube fabric to an outlet opening through a suction pipe, taking the U shape tube fabric where the inner toe seam has already been stitched from the outlet opening, stitching the outer toe seam;

(5) forming a one-piece-vamp semifinished product: overlapping the inner vamp and the outer vamp by extending the inner vamp into the tube of the outer vamp in the shoe opening part, forming a two-layer one-piece-vamp semifinished product;

(6) performing reshaping, setting and shape fixing on the vamp: putting the one-piece-vamp semifinished product on a shoe tree, using steam to perform scalding, making adjustment to the vamp and patterns for position alignment during the course of scalding, and hot melt silk being melt to adhere the inner, outer vamps to each other as one piece, taking the shoe tree out after cooling, forming the one-piece-vamp.

The present invention adopts a stereoscopic weaving method, smartly designs the weaving order, weaves a vamp with inner and outer layers integrally, the inner and outer vamps are connected to be a U shape tube, after the toe cap seal openings of the inner and outer vamps at both ends are stitched, overlapping the inner vamp with the outer vamp from the shoe opening part where they are connected, namely forming a one-piece-vamp semifinished product, the manufacture process is simple, the production efficiency is high, the vamp is well ventilated, the size and model are standard and unified, no leftover bits and pieces are generated; because hot melt silk and stretch yarn are added and woven when weaving is performed, hot melt silk of the inner and outer vamps are heated to be melt by heat when scalded, so that the two layers of the vamp are adhered to each other and stiffness is improved, and local texturing at the shoe opening, etc, improves the coverage and setting effects of the vamp, the two-layer vamp improves stiffness and straightness of the vamp, the vamp is not prone to collapse, the quality of modeling is good, the appearance and quality of the vamp is improved; the two-layer vamp is of a tube shape, it naturally forms a soft and comfortable insole, glue is directly brushed on the bottom of the two-layer vamp, it is time saving and labor saving, the cost of shoemaking is greatly reduced.

Furthermore, in order to achieve jacquard with rich colors and gradations, said vamp machine is equipped with 1 main color opening, the main color opening is equipped with 8 main color opening yarn feeding orifices, hot melt silk is fed by the main color opening yarn feeding orifice, said vamp machine is equipped with 6 match color openings, each match color opening is equipped with 3 match color opening yarn feeding orifices and 1 stretch yarn yarn feeding orifice. The main color opening yarn feeding orifices and the match color opening yarn feeding orifices work in cooperation with each other. Under a same horizontal woven row, 2 main color opening yarn feeding orifices(wherein one for main color yarn, the other for hot melt silk) are used, each of 6 match color openings uses 1 match color yarn feeding orifice, i.e. at a local jacquard portion, a same horizontal woven row may implement at most 7 colors.

Furthermore, said 8 main color opening yarn feeding orifices are used for inner yarn feeding, outer yarn feeding, inner hot melt silk, outer hot melt silk, inner heel yarn feeding and hot melt silk, outer heel yarn feeding and hot melt silk, starting opening yarn feeding, scrap yarn yarn feeding, respectively, and according to the main color of the inner outer vamp and the process requirements, 4-8 main color opening yarn feeding orifices are chosen for yarn feeding. The starting opening yarn feeding and the scrap yarn yarn feeding respectively need one yarn feeding orifice, and their function is to implement the joining thread locating function of starting opening weaving and seal opening stitching. According to inner and outer main colors and the process requirements, inner yarn feeding, outer yarn feeding, inner hot melt silk, outer hot melt silk need 1-4 yarn feeding orifices, and according to the main colors and the process requirements, inner heel yarn feeding and hot melt silk, outer heel yarn feeding and hot melt silk need 1-2 yarn feeding orifices, each of these yarn feeding orifices has 2 needle holes, they may pass main color yarn and hot melt silk through at the same time to feed yarn and hot melt thread to the heel, so as to achieve heel jacquard.

Furthermore, in order to make the woven one-piece-vamp to cover feet better and improve the comfort of feet, an outer shoe shaft and an inner shoe shaft are provided between said outer heel and outer shoe opening, between the inner shoe opening and the inner heel, respectively, in said step (2), when U shape tube fabric is woven, said stretch yarn yarn feeding orifice cooperates with the main color opening yarn feeding orifice, the inner and outer shoe openings and the inner and outer shoe shafts are textured and woven.

Furthermore, in order to make aligned stitching more accurate, in said step (3), U shape tube fabric is grasped and rotated to the stitching device muzzle bell by the automatic robot arm, it is located by a sewing needle disc and pushed straight by a top shaft, so that the inner toe opening is located at the sewing needle position of the apparatus.

Furthermore, in said step (4), a seam disc machine is used to perform manual stitching on the outer toe seam, then the starting opening yarn and the scrap thread at the staring opening are manually removed.

Furthermore, in order to perform reshaping, setting better, in said step (6), 100° C.-120° C. steam is used to perform scalding, a transparent alignment plate is used to make fine adjustment to the vamp linking portions or patterns manually for position alignment during the course of scalding.

The present invention also provides a one-piece-woven-vamp, it includes a one-piece-woven tubulous outer vamp and an inner vamp, toe caps of the outer vamp and the inner vamp are closed, the inner vamp is back to fold into the outer vamp from the shoe opening part to be a two-layer stereoscopic vamp and adhered to each other as one piece; the semifinished product of the vamp is one-piece-woven U shape tube fabric, one side of U shape tube fabric is the outer vamp, the other side is the inner vamp, a turn in the middle of U shape tube fabric is the shoe opening part where the inner vamp and the outer vamp intersect.

Furthermore, said one-piece-woven-vamp is manufactured by the vamp manufacture method according to the above mentioned technical solution.

Furthermore, said outer vamp is woven with jacquard, said stretch yarn is spandex cladded yarn.

The advantageous effects of the present invention are:

1. the manufacture process is simple, the production efficiency is high, no leftover bits and pieces are generated, the production cost is reduced.

2. the manufactured vamp has good ventilation and supportability, the size and model of the vamp are standard and unified, the vamp is straight, the quality of modeling is good.

3. a product with rich colors and gradations may be achieved, jacquard function can be achieved at the toe cap and the heel, the vamp is more esthetic.

4. the two-layer vamp is of a tube shape, it naturally forms a soft and comfortable insole, glue is directly brushed on the bottom of the two-layer vamp to adhere to the shoe sole, in comparison with stitching the shoe, the process is more simple, it is time saving and labor saving, the cost of shoemaking is greatly reduced.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Hereinafter, the present invention is described in further detail in conjunction with embodiments, but the present invention is not limited to the following embodiments.

Figure 1:
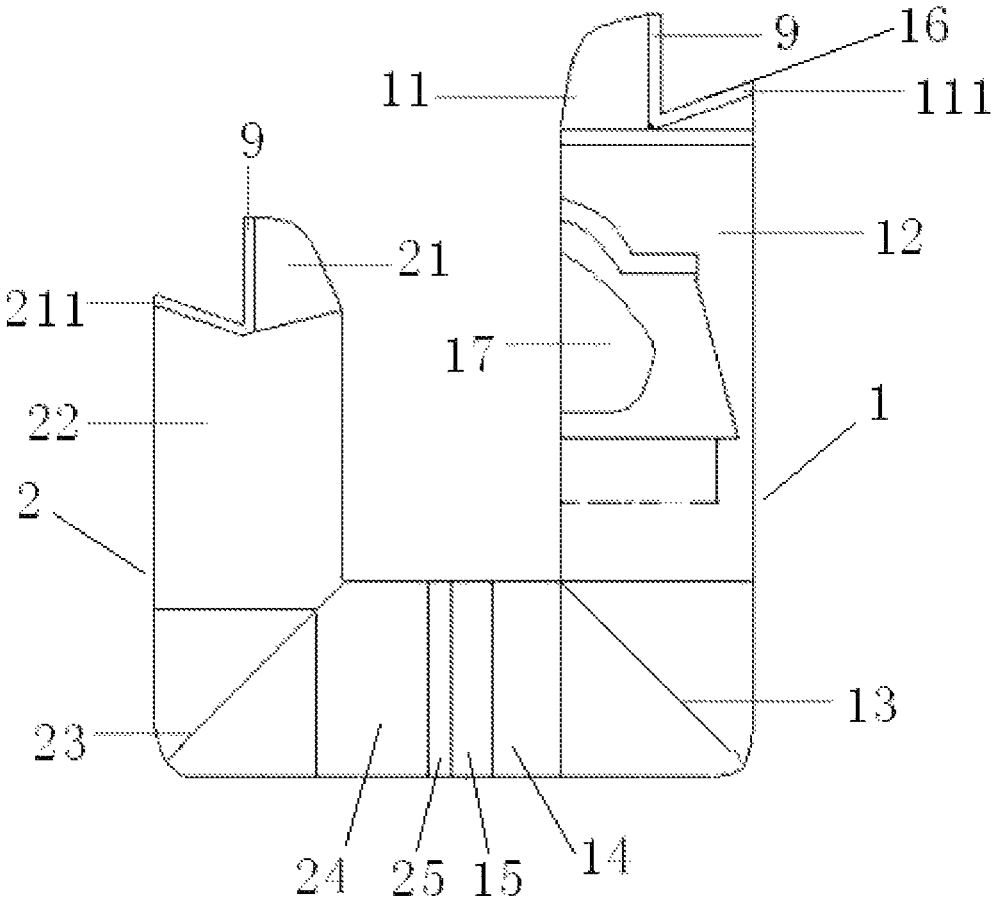
FIG. 1 is a structural diagram of U shape tube fabric of the present invention.

As shown in FIG. 1, a one-piece-vamp manufacture method includes the following steps:

(1) weaving preparation: arranging different required raw material color yarn, hot melt silk and stretch yarn at a main color opening yarn feeding orifice, a match color opening yarn feeding orifice and a stretch yarn yarn feeding orifice according to vamp patterns and process requirements, loading written program into a vamp machine, inputting corresponding parameters by an operating platform, the stretch yarn adopting spandex cladded yarn;

(2) weaving U shape tube fabric: one side of the U shape tube fabric being an outer vamp 1, the other side being an inner vamp 2, both the outer vamp 1 and the inner vamp 2 being of a tube shape, a turn in the middle of the U shape tube fabric being a shoe opening part where the inner vamp 2 and the outer vamp 1 intersect; the vamp machine weaving in an order of a starting opening 16, an outer toe cap 11, an outer shoe body 12, an outer heel 13, an outer shoe shaft 14, an outer shoe opening 15 to an inner shoe opening 25, an inner shoe shaft 24, an inner heel 23, an inner shoe body 22, an inner toe cap 21, the stretch yarn yarn feeding orifice cooperating with the main color opening yarn feeding orifice during the course of weaving, achieving technical effects of local jacquard, local texturing at the outer vamp 1 with respect to processes and functions required by respective portions of the vamp, texturing and weaving being possible to be performed on the shoe opening portion and the shoe shaft portion, of course, the jacquard process being also possible to be performed on the inner vamp 2 according to the design;

(3) stitching an inner toe seam: grasping and rotating the woven U shape tube fabric to a stitching device muzzle bell by an automatic robot arm, locating it by a sewing needle disc and pushing it straight by a top shaft, locating the inner toe opening 211 at a sewing needle position of the apparatus, performing aligned automatic stitching along the inner toe opening 211 to form the inner toe seam;

(4) stitching the outer toe seam: sucking the U shape tube fabric to an outlet opening through a suction pipe, taking the U shape tube fabric where the inner toe seam has already been stitched from the outlet opening, using a seam disc machine to perform manual stitching along the outer toe opening 111 to form the outer toe seam, then manually removing the starting opening yarn and the scrap thread 9 at the starting opening 16.

(5) forming a one-piece-vamp semifinished product: overlapping the inner vamp and the outer vamp by extending the inner vamp 2 into the tube of the outer vamp 1 in the shoe opening part, making inner, outer toe caps 21, 11, inner, outer shoe bodies 22, 12, inner, outer heels 23, 13, inner, outer shoe shafts 24, 14, inner, outer shoe openings 25, 15 correspond to each other respectively, forming a two-layer one-piece-vamp semifinished product;

(6) performing reshaping, setting and shape fixing on the vamp: putting the one-piece-vamp semifinished product on a shoe tree, using 100° C.-120° C. to perform scalding, using a transparent alignment plate to make fine adjustment to the vamp linking portions or patterns manually for position alignment during the course of scalding, and hot melt silk being melt to adhere the inner, outer vamps 2, 1 to each other as one piece, taking the shoe tree out after cooling for 2-3 minutes, forming the one-piece-vamp.

In order to achieve jacquard with rich colors and gradations, said vamp machine is equipped with 1 main color opening, the main color opening is equipped with 8 main color opening yarn feeding orifices, hot melt silk is fed by the main color opening yarn feeding orifice, said vamp machine is equipped with 6 match color openings, each match color opening is equipped with 3 match color opening yarn feeding orifices, 1-2 match color opening yarn feeding orifices are usually used, at most 3 match color opening yarn feeding orifices may be used according to the process design, the match color opening is also equipped with 1 stretch yarn yarn feeding orifice. The main color opening yarn feeding orifices and the match color opening yarn feeding orifices work in cooperation with each other. Under a same horizontal woven row, 2 main color opening yarn feeding orifices (wherein one for main color yarn, the other for hot melt silk) are used, each of 6 match color openings uses 1 match color yarn feeding orifice, i.e. at a local jacquard portion, a same horizontal woven row may implement at most 7 colors.

Said 8 main color opening yarn feeding orifices are used for inner yarn feeding, outer yarn feeding, inner hot melt silk, outer hot melt silk, inner heel yarn feeding and hot melt silk, outer heel yarn feeding and hot melt silk, starting opening yarn feeding, scrap yarn yarn feeding, respectively, and according to the main color of the inner outer vamp 1 and the process requirements, 4-8 main color opening yarn feeding orifices are chosen for yarn feeding. The starting opening yarn feeding and the scrap thread yarn feeding respectively need one yarn feeding orifice, and their function is to implement the joining thread locating function of starting opening weaving and seal opening stitching. According to inner and outer main colors and the process requirements, inner yarn feeding, outer yarn feeding, inner hot melt silk, outer hot melt silk need 1-4 yarn feeding orifices, and according to the main colors and the process requirements, inner heel yarn feeding and hot melt silk, outer heel yarn feeding and hot melt silk need 1-2 yarn feeding orifices, the heel yarn feeding and hot melt silk yarn feeding orifices have two needle holes, they may pass main color yarn and hot melt silk through at the same time. Usually, with respect to heel jacquard, jacquard is performed on only the heel of the outer vamp 1, whereas the inner heel vamp generally does not need jacquard, and if it needs jacquard, it uses a method which is the same as that for the outer vamp. Heel jacquard can only use main color opening yarn feeding orifices, and configure yarn feeding orifices according to different process requirements and jacquard colors, a same vamp may use 2-5 yarn feeding orifices simultaneously to perform jacquard weaving, namely heel jacquard colors may be up to 2-5 colors. Toe cap jacquard is the same as heel jacquard weaving.

Figure 2:
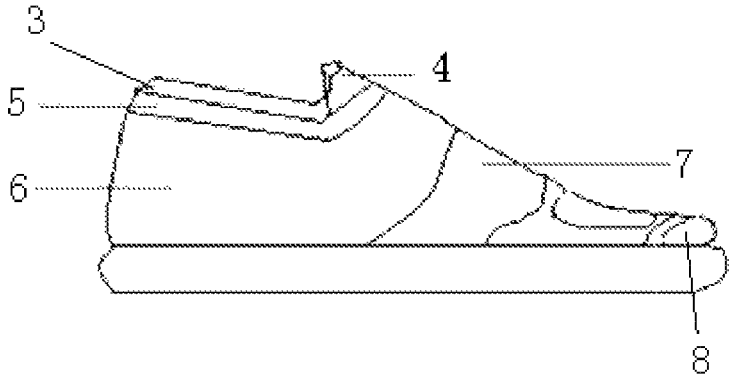
FIG. 2 is a structural diagram in which a vamp manufactured according to the present invention is applied to shoes.

As shown in FIGS. 1 and 2, the present invention also provides a one-piece-woven-vamp, it includes a one-piece-woven tubulous outer vamp 1 and an inner vamp 2, toe caps of the outer vamp 1 and the inner vamp 2 are closed, the inner vamp 2 is back to fold into the outer vamp 1 from the shoe opening part to be a two-layer stereoscopic vamp and adhered to each other as one piece; the semifinished product of the vamp is one-piece-woven U shape tube fabric, one side of U shape tube fabric is the outer vamp 1, the other side is the inner vamp 2, both the outer, inner vamps are of a tube shape, a turn in the middle of the U shape tube fabric is the shoe opening part where the inner vamp 2 and the outer vamp 1 intersect, after the two ends of U shape tube fabric, i.e. toe caps of the inner, outer vamps 2, 1 are stitched, the inner vamp 2 are extended into the tube of the outer vamp 1 in the shoe opening part to form the one-piece-vamp semifinished product; when the one-piece-vamp is woven, stretch yarn and hot melt silk and raw material color yarn are woven together, so that the vamp is textured at least in shoe opening part. The one-piece-woven-vamp is manufactured by the vamp manufacture method according to the above mentioned technical solution, its outer vamp 1 is woven with jacquard to form the vamp pattern 17, said stretch yarn is spandex cladded yarn. The vamp is taken out after it is reshaped, set, shape-fixed, cooled, to form a stereoscopic vamp including a shoe opening 3, a shoe tongue 4, a shoe shaft 5, a shoe heel 6, a shoe body 7, a toe cap 8, the shoe tongue 4 is located at the front of the shoe opening 3, the shoe shaft 5 is located between the shoe opening 3 and the shoe heel 6, glue is brushed on the bottom of the outer layer of the stereoscopic vamp to adhere to a shoe sole, to make the shoe. The two-layer vamp is of a tube shape, it naturally forms a soft and comfortable insole, glue is directly brushed on the bottom of the two-layer vamp to adhere to the shoe sole, in comparison with stitching the shoe, the process is more simple, it is time saving and labor saving, the cost of shoemaking is greatly reduced.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations in use or operation in addition to the orientation depicted in the figures. For example, if figures are turned over, elements described as "below" or "beneath" other elements or features would then be oriented "above" the other elements or features. Thus, the example term "below" can encompass both an orientation of above and below. An exemplary embodiment may be otherwise oriented (rotated 90 degrees or at other orientations) and the spatially relative descriptors used herein interpreted accordingly.

The above are only preferred embodiments of the present invention, but the protection scope of the present invention is not limited thereto. Any modifications, equivalent substitutions, improvements, etc., made within the spirit and principle of the present invention are to be contained within the protection scope of the present invention.

The invention claimed is:

1. A one-piece-vamp manufacture method comprising the following steps:

(1) weaving preparation: arranging different required raw material color yarn, hot melt silk and stretch yarn at a main color opening yarn feeding orifice, a match color opening yarn feeding orifice and a stretch yarn feeding orifice according to vamp patterns and process requirements, loading written program into a vamp machine, and inputting parameters corresponding to the vamp patterns and process requirements;

(2) weaving U shape tube fabric: one side of the U shape tube fabric being an outer vamp, the other side being an inner vamp, both the outer vamp and the inner vamp being of a tube shape, a turn in the middle of the U shape tube fabric being a shoe opening part where the inner vamp and the outer vamp intersect; the vamp machine weaving in an order of a starting opening, an outer toe cap, an outer shoe body, an outer heel, an outer shoe opening to an inner shoe opening, an inner heel, an inner shoe body, an inner toe cap, during the course of weaving, achieving technical effects of local jacquard and local texturing at portions of the outer vamp;

(3) stitching an inner toe seam: grasping the woven U shape tube fabric to a stitching device by an automatic robot arm, locating an inner toe opening at a needle position of the stitching device, performing aligned automatic stitching along the inner toe opening to form the inner toe seam;

(4) stitching the outer toe seam: sucking the U shape tube fabric to an outlet opening through a suction pipe, taking the U shape tube fabric where the inner toe seam has already been stitched from the outlet opening, stitching the outer toe seam;

(5) forming a one-piece-vamp semifinished product: overlapping the inner vamp and the outer vamp by extending the inner vamp into the tube of the outer vamp in the shoe opening part, forming a two-layer one-piece-vamp semifinished product; and (6) performing reshaping, setting and shape fixing on the vamp: putting the one-piece-vamp semifinished product on a shoe tree, using steam to perform scalding, making adjustment to the vamp and patterns for position alignment during the course of scalding, melting the hot melt silk to adhere the inner and outer vamps to each other as one piece, taking the shoe tree out after cooling, and forming the one-piece-vamp.

2. The one-piece-vamp manufacture method according to claim 1, wherein: said vamp machine is equipped with 1 main color opening, the main color opening is equipped with 8 main color opening yarn feeding orifices, and the hot melt silk is fed by at least one of the main color opening yarn feeding orifices, said vamp machine is equipped with 6 match color openings, each match color opening is equipped with 3 match color opening yarn feeding orifices and 1 stretch yarn feeding orifice.

3. The one-piece-vamp manufacture method according to claim 2, wherein: said 8 main color opening, yarn feeding orifices are used for inner yarn feeding, outer yarn feeding, inner hot melt silk, outer hot melt silk, inner heel yarn feeding and hot melt silk, outer heel yarn feeding and hot melt silk, starting opening yarn feeding, and scrap yarn feeding, respectively, and according to a main color of the inner outer vamp and the process requirements, 4-8 main color opening yarn feeding orifices are chosen for yarn feeding.

4. The one-piece-vamp manufacture method according to claim 1 wherein: an outer shoe shaft and an inner shoe shaft are provided between said outer heel and outer shoe opening, and between the inner shoe opening and the inner heel, respectively, in said step (2), and when the U shape tube fabric is woven, said stretch yarn feeding orifice cooperates with the main color opening yarn feeding orifice, so as to allow the inner and outer shoe openings and the inner and outer shoe shafts to be textured and woven.

5. The one-piece-vamp manufacture method according to claim 1, wherein: in said step (3), the U shape tube fabric is grasped and rotated to the stitching device muzzle bell by the automatic robot arm, said U shape tube fabric being located by a sewing needle disc and pushed straight by a top shaft, so that the inner toe seam is located at the sewing needle position of the stitching device.

6. The one-piece-vamp manufacture method according, to claim 1, wherein: in said step (4), a seam disc machine is used to perform manual stitching on the outer toe seam, and a starting opening yarn and a scrap thread at the starting opening are subsequently manually removed.

7. The one-piece-vamp manufacture method according to claim 1, wherein: in said step (6), 100° C. to 120° C. steam is used to perform scalding, and a transparent alignment plate is used to make fine manual adjustments to the vamp and patterns for position alignment during, the course of scalding.

* * * * *